US006121882A

United States Patent [19]

Jaul et al.

[11] Patent Number: 6,121,882

[45] Date of Patent: Sep. 19, 2000

[54] MUNITIONS COOK-OFF WARNING SYSTEM

[75] Inventors: Warren K. Jaul; Gerhard W. Thielman, both of Ridgecrest, Calif.; Michael C. Vogt, Westmont, Ill.; Rodney M. Harris; Jack M. Pakulak, both of Ridgecrest, Calif.

[73] Assignee: The United States of America as represented by the Secretary of the Navy, Washington, D.C.

[21] Appl. No.: 09/246,199

[22] Filed: Jan. 4, 1999

[51] Int. Cl.[7] ..... G08B 17/00

[52] U.S. Cl. ..... 340/584; 340/588; 340/589; 102/481

[58] Field of Search ..... 340/584, 588, 340/589; 60/223; 102/481

[56] References Cited

U.S. PATENT DOCUMENTS

| | | | |
|---|---|---|---|
| 4,569,287 | 2/1986 | Pakulak, Jr. et al. | 102/293 |
| 4,620,083 | 10/1986 | Andre | 219/491 |
| 4,961,313 | 10/1990 | Dolan | 60/223 |
| 5,875,416 | 2/1999 | Kanno | 702/130 |

*Primary Examiner*—Jeffery A. Hofsass
*Assistant Examiner*—Son Tang
*Attorney, Agent, or Firm*—Gregory M. Bokar; Earl H. Baugher, Jr.

[57] ABSTRACT

A process for indicating the likelihood of cook-off for energetic materials by calculating the heat flux and chemical venting relative to known critical parameters for the energetic materials. The process further may include an alarm.

20 Claims, 3 Drawing Sheets

MUNITIONS COOK-OFF WARNING SYSTEM

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to the unplanned reaction of energetic materials as a result of exposure to unplanned thermal stimuli. This reaction is termed cookoff. More particularly, the present invention is a process for calculating explosive hazards in munitions by factoring heat flux and chemical venting. Most particularly, the process calculates the heat flux and chemical venting occurring within a given type of munitions which are compared with known critical parameters, allowing a measuring of the possibility of thermally initiated "cook-off" of the munitions.

2. Brief Description of the Related Art

Munitions storage is a hazardous endeavor. One of the primary dangers from storing rockets or missiles arises not just from the explosive charge or warhead, but also the solid rocket propellant itself. In particular, fires and other sources of high ambient heat in proximity to the energetic material create a high risk that the material will prematurely ignite causing a violent energy release.

Cook-off may occur to energetic materials even though they are not directly exposed to an open flame. Ordnance cook-off includes the rapid burning, deflagration, explosion or detonation of a energetic material, such as a propellant, fuze booster charge or explosive in munitions, due to a given amount of heating over a given amount of time. A substantial danger exists that the energetic material will be ignited when it is exposed to high ambient temperatures over a prolonged period of time, generally when the temperature gradually reaches a predetermined ignition temperature, such as temperatures in excess of the critical temperature. Stockpiles of munitions, such as weapons stored in armories, are particularly susceptible to exposure to radiative or convection heat source. Specifically, such an event may occur when a shipboard weapons magazine, which does not contain a fire, is gradually heated due to a fire in a nearby compartment, or other heat source that heats the magazine in which the munition is being stored. The "cook-off" ignition of a single round, in such a case, may trigger the explosion of the warhead, or the ignition and/or explosion of near-by rounds.

Currently, thermally initiated cook-off is predicted from an estimation, based on a constant heat rate, and an Arrenhius rate law for the chemical decomposition of many energetic materials used in the United States Navy. Using this decomposition mechanism to describe the heat release, thermal models of numerous munitions have been constructed dependent on temperature time histories, for predicting munition's cook-off time. Cook-off has caused significant damage on board naval combat vessels. On board vessels, such as aircraft carriers, cook-off has caused increases in damage from deck fires resulting in substantial loss of life and material damage to these capital ships. Fire suppression and fire fighting efforts are inhibited by hazards of ordnance cook-off. With normal operations requiring ordnance to be located on and around aircraft on the carrier deck, a normally controllable fire can degrade the readiness of these ships to perform their mission. Since the occurrence of the catastrophic fires aboard the USS FORRESTAL and USS ENTERPRISE, the U.S. Navy has instituted cook-off improvement programs within the Navy. Significant improvements have been made in increasing ordnance cook-off times, including systems such as heat path interruption techniques, for example, using internal insulating liners and external intumescent coatings. These approaches may slow down the flow of heat into a missile, but if the ordnance is heated for a sufficiently long time, cook-off still occurs. The ability to predict cook-off parameters for the propellant and/or explosive confined within the ordnance readily improves the ability of these ships to increase operational commitments. Ideally, the ability to predict ordnance cook-off includes both slow and rapid rates of heating. Slow cook-off reactions and fast cook-off reactions for the same ordnance item can vary greatly in severity.

There is need for providing cook-off estimations for ordnance under a full range of heat conditions, such as being heated above critical reaction temperatures of the energetic materials inside, and/or with subsequent cooling, exposure to low and/or high heating rates above the critical temperature and other such variations.

SUMMARY OF THE INVENTION

The present invention comprises a process for determining energetic material cook-off comprising the steps of continuously calculating a heat exposure rate and integrated heat flux to an energetic material; calculating a decomposition chemical formation rate of the energetic material independently of calculating the heat exposure rate; mathematically factoring the calculated heat exposure rate and integrated heat flux with the calculated decomposition chemical formation rate; and, comparing the factored calculated heat exposure rate and integrated heat flux, and the calculated decomposition chemical formation rate to a predetermined cook-off measurement, wherein the likelihood of cook-off is determined.

The present invention further comprises the process as previously described with the further step of initiating at least one indicator at a given likelihood of cook-off.

These and other features of the present invention provide for a process that indicates and/or warns of cook-off of energetic materials.

DETAILED DESCRIPTION OF THE PREFERRED EMBODIMENTS

The present invention is a process for determining the likelihood of cook-off of an energetic material, and the degree of likelihood of that cook-off. The present invention additionally warns of the possibility of cook-off to personnel located in close proximity or remotely from the energetic material. Typically, the energetic material comprises a propellent, explosive and/or booster of munitions, varying between a wide variety of any of several sizes and weights of munitions. However, the process may be used on any energetic materials subject to cook-off.

The energetic material may be any material that is prone to cook-off, with the determination of whether a certain material is an energetic material being determinable by those skilled in the art. Typically, energetic materials non-exclusively include propellents, explosives, and other like materials, with the materials also used for such purposes as a fuse detonation material.

The process of the present invention for determining energetic material cook-off comprises the steps of continuously calculating a heat exposure rate and integrated heat flux to an energetic material, calculating a decomposition chemical formation rate of the energetic material independently of calculating the heat exposure rate, mathematically factoring the calculated heat exposure rate and integrated heat flux with the calculated decomposition chemical formation rate, and, comparing the factored calculated heat exposure rate and integrated heat flux, and the calculated decomposition chemical formation rate to a predetermined cook-off measurement. This process yields a determination of whether a weapon, or other type of energetic material, is a candidate for cook-off, and the degree of likelihood of that cook-off. It is also functional in predicting or estimating the time at which the cook-off event results in an explosive occurrence. The process also presents an indication of the likelihood of cook-off.

Figure 1:
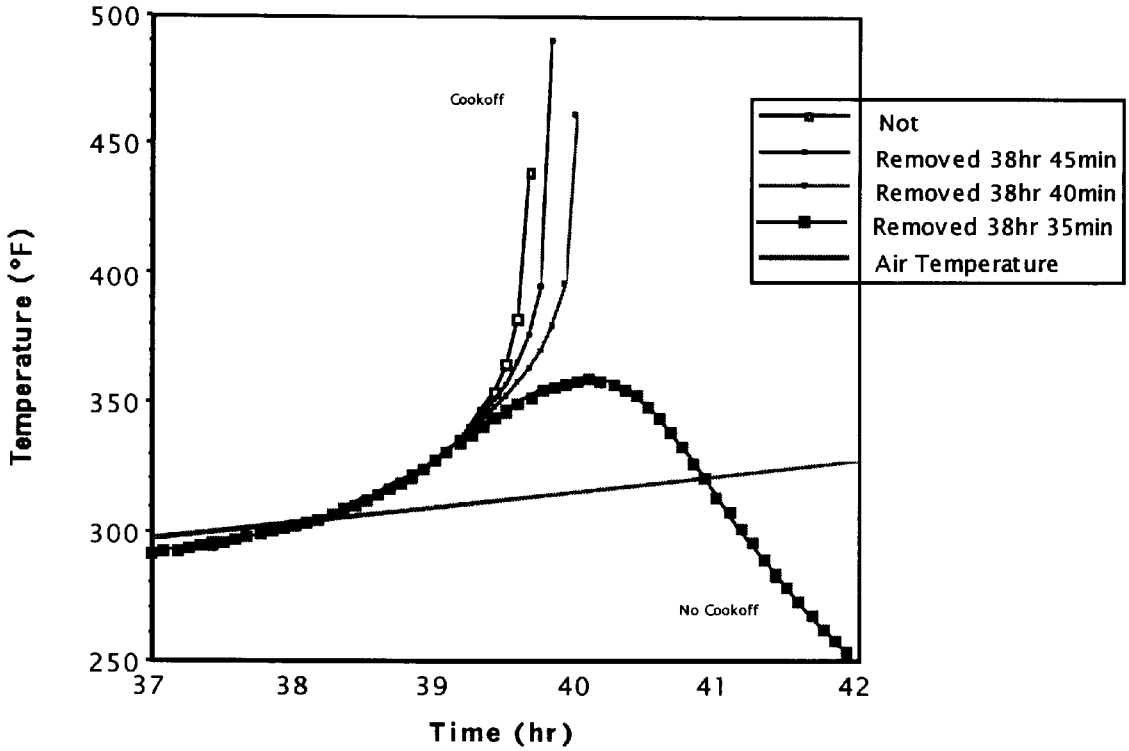
FIG. 1 is a plot showing cook-off as a factor over various times of heat exposure.

FIG. 1 is a plot showing cook-off as a factor over various times of heat exposure. Once munitions receive enough energy, even cooling the external surface proves ineffective in preventing a catastrophic reaction of the energetic material. The reaction may occur at the surface of the energetic material nearest the case wall or at a point deep within the munitions. FIG. 1 shows the result when an energetic material in a munition that is gradually heated at an incremental rate of 6° F./hour for a specified period, after which the heat source is removed and the munitions surface is instantly cooled to room temperature (approximately 70° F.). Cook-off occurs most rapidly with no cooling, and will occur, but not as rapidly, with cooling at 38 hours, 45 minutes and 38 hours and 40 minutes. Cooling at 38 hours and 35 minutes prevents cook-off. As seen in FIG. 1, there is a point of no return (PNR) for the cook-off for this particular device is between 38 hours and 40 minutes and 38 hours and 35 minutes. The present invention measures and stores heat and chemical out-gassing information about a weapon, and measures the integrated heat flux and external vapor envelope up to the PNR versus heating rate. The collected information is continually compared with the integrated value of the energy received by the munitions, along with an updated readings of out-gassing events to determine whether the weapon has reached a condition where cook-off will occur.

Figure 2:
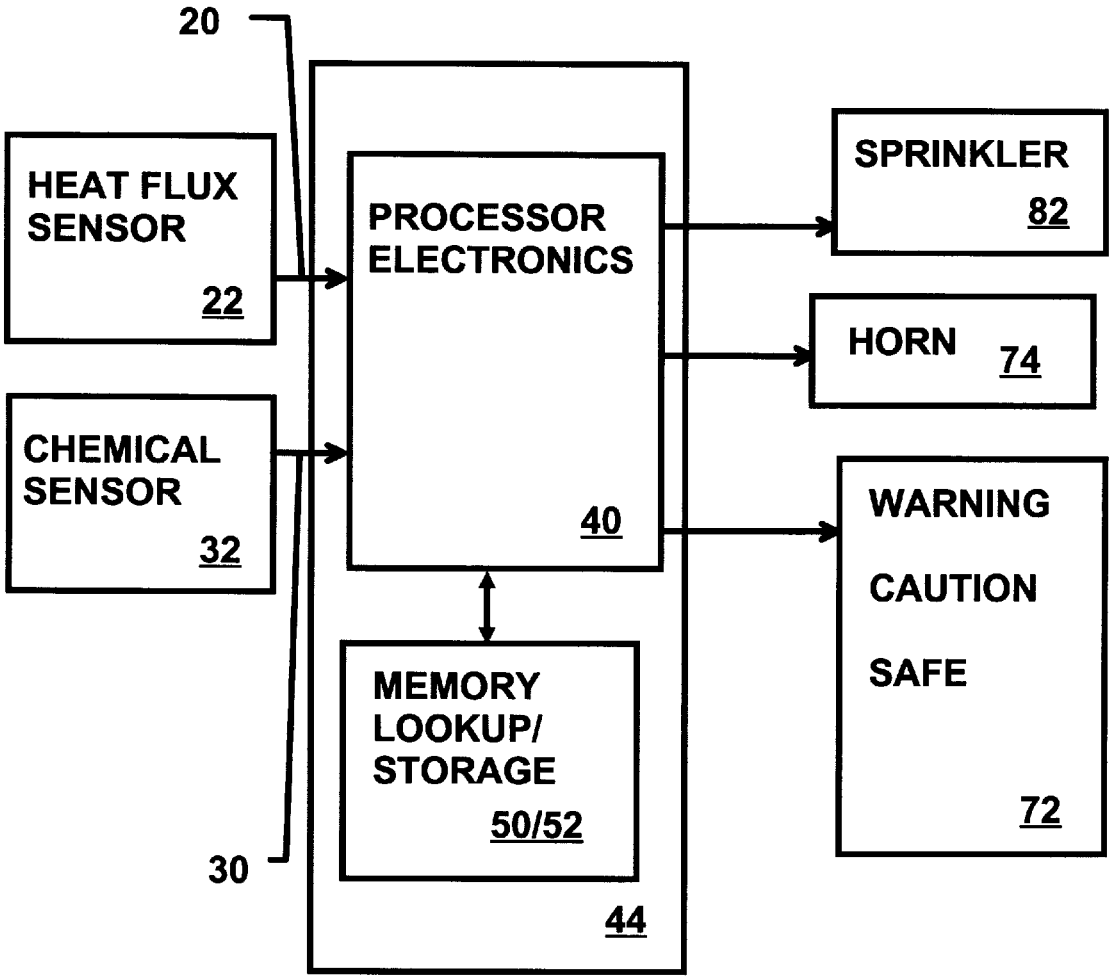
FIG. 2 is a functional schematic for value formulation and comparison of the present invention; and, FIG. 3 is a plot of the predicted relative energy required to cook-off a 7-inch diameter rocket motor as a function of heating rate.

FIG. 2 is a functional schematic for value formulation and comparison of the present invention. As seen in FIG. 2, the process for determining energetic material cook-off continuously calculates a heat exposure rate 20 of an energetic material 10, further calculates a decomposition chemical formation rate 30 of the energetic material 10 independently of calculation of the heat exposure rate 20, mathematically factors 40 the calculated heat exposure rate 20 with the calculated decomposition chemical formation rate 30, and, compares the factored calculated heat exposure rate and the calculated decomposition chemical formation rate to a predetermined cook-off measurement 50. This permits the likelihood of cook-off to be determined 60. The process may further comprise the step of initiating at least one indicator 70 at a given likelihood of cook-off.

The step of calculating the heat exposure rate 20 of the process preferably comprises a heat flux sensor 22. The heat flux sensor 22 senses the temperature and heat flux to the munition 10 on a continual basis, that provides an estimate of the internal heat generation and consequently an estimate of any subsequent time to cook-off. Micro-sensor heat flux sensors 22 that can detect heat flux include such devices as the Heat Flux Microsensor (HFM-6 D/H) developed by Vatell Corporation of Christiansburg, Va., and are capable of detecting very low level heat flux and withstanding temperature of about 1470° F., uncooled. Preferably, at least one heat flux sensor 22 performs the step of continuously measuring temperature and heat flux, more preferably from about two or more heat flux sensors 22, and most preferably from about two to about 100 heat flux sensors 22 perfonm the step of continuously monitoring the temperature and heat flux. The heat flux sensors 22 preferably are dispersed over the surface of the munition. Dispersion of the heat flux sensors 22 may be random, evenly distributed, locally concentrated for hot spot detennination, or any other like sensor arrangement for the determination of heat flux measurements, with the arrangement being determinable by those skilled in the art.

Figure 3:
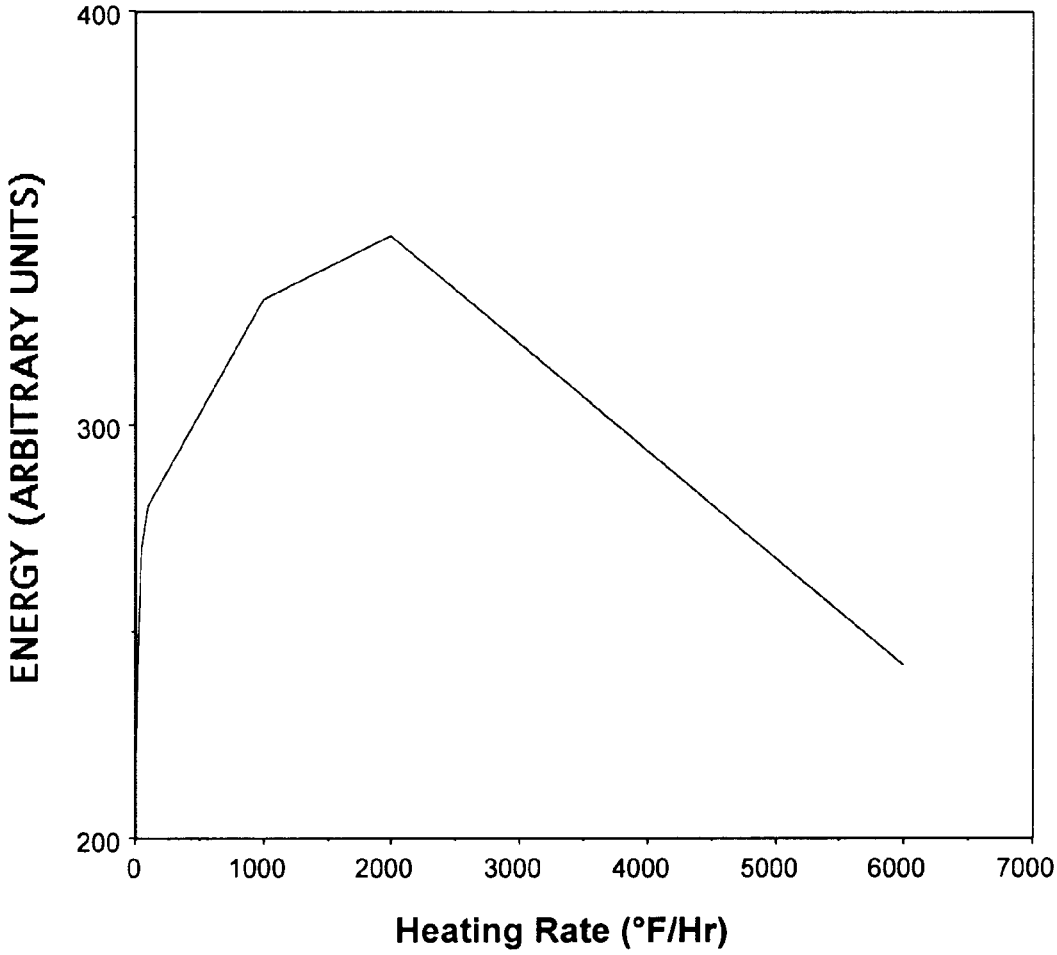

As seen in FIG. 3, a plot of the predicted energy required to cook-off a 7-inch diameter rocket motor as a function of heating rate. Different levels of heat flux were applied as boundary conditions and the integrated energy up to the PNR was predicted, and plotted in FIG. 3. A linearized rate of change of the case wall temperature provided the value of heating rate, for each munition, a curve provides a value of integrated heat flux that leads to reaction. Values of heat energy above the curve mean cook-off occurs and values below mean it does not. It is believed that every munition probably has its own unique curve of total energy versus heating rate.

The heat flux is continuously measured to provide a "heat history" for the energetic material in munitions. This history provides information to evaluate the integrity of the energetic material. This information is compared to a stored database of total energy versus heating rate table to evaluate the likelihood of cook off occurring.

The calculation of the chemical decomposition 30 of the process comprises at least one chemical sensor 32 that performs a secondary function to the heat flux sensor 22. One or more chemical sensors 32 perform the step of calculating the decomposition chemical formation rate 30. Chemical sensors 32 include devices developed at Argonne National Laboratory of Argonne, Ill., such as the voltammetric/electrocatalytic (V/EC) microsensor and Miniature Sensor Support System (MSSS), that have the capability of multiple gas identification. These chemical sensors 32 are made of ceramic-metallic materials to allow functional operation at extreme temperatures. The chemical sensor 32, after being exposed to a given gas or mixture, stores characteristic chemical "signatures". As such, the chemical sensor 32 monitors and identifies the chemical vapors produced by the munitions 10. Any quantitative data of the leaks or out-gassing of the munitions are used to support or correct the initial cook-off estimation time from the heat flux sensor 22. Preferably the present invention comprises a single array-type chemical sensor 32. The chemical sensor 32 may be internally or externally located to any compartment housing the energetic material, with an external configuration being preferred. The heat flux sensor and the chemical decomposition sensor are independent because each sensor collects distinct information for analysis.

The heat history, such as elevated temperatures, and out-gassing events for individual munitions are stored 42 in a programmable memory system 56. Only the history for the specific type of munitions needs to be stored. The stored information 52 may be periodically accessed to determine whether a weapon is still operational, or whether the weapon has degraded to such an extent that it requires replacement. Comparison of the munitions heat history 52, correlated with chemical outgassing data 30, and a predetermined cook-off measurement 50, for a given weapon is done with an electronics package 44 having an electronic processor. An electronic processor will acquire the sensors' signals, convert them to a usable format, monitor time, and determine whether the weapon will react. Electronics packages 44, such as microcontroller-based artificial intelligence algorithms, may use the stored signature to identify outgassing conditions, having sensitivity to many gases including hydrocarbons down to from about 1 to about 10 ppm range. The predetermined cook-off measurement of the present invention is specifically generated for various configurations of various energetic materials 10. Typically, the energetic materials arc component parts of military munitions, rocket propellents, civilian explosive charges, and/or other similar devices. As such, each type of device possesses its own calculable total energy producing cook-off and chemical characteristic from the cook-off occurance. These characteristics may be used to mathematically derive a value corresponding to a given likelihood of cook-off for a particular type of device. With the comparison between a monitored energetic material device, calculating the actual integrated heat flux and chemical factors, with the data from similar devices that have been "cooked-off", the possibility or likelihood of cook-off of the monitored device may be determined.

Cook-off occurs with the self-heating of a munition, after the energetic material in the munition has begun to self-sustain the heating process. At this point, the munitions will continue self-heating, until either they are sufficiently cooled or cook-off occurs. Sufficient cooling of the munitions requires that the munitions lose heat rapid enough to the surrounding area allowing the internal temperature to be reduced to a point where the exothermic energy release within the munitions is halted. Even with cooling, in certain situations, cook-off will occur if the point of no return has passed. The amount of energy required to cause the munition to self-heat varies with the size (diameter), geometry (center bore, no bore), material (types of energetic material, thickness and type of liner and/or insulator, exterior coatings, ablators and insulators), and/or heat patches (uneven heating). The design of the munitions may provide pathways for the transfer of heat in the munitions, such as through the fuse, or may provide for the shielding of heat in the munitions, such as wing or fins on the missile body shading portions of the missile's skin. Variations in liner and/or insulator thickness affect heat flux. Typically, the thickness of a munitions case is from about 0.005 inches to about 0.5 inches, more typically from about 0.05 inches to about 0.15 inches, and most typically from about 0.06 inches to about 0.1 inches. Liners and insulators typically range from about 0.005 inches to about 0.5 inches, more typically from about 0.01 inches to about 0.3 inches, and most typically from about 0.03 inches to about 0.07 inches. Sizes of weapons for which this invention s most applicable include the approximately fifty pound shillelagh anti-tank weapon that is approximately six inches in diameter and four feet long to significantly larger missiles, such as the Trident submarine-launched Ballistic missile that weighs several tons. Different munitions have varying types of metal cases, such as the Shillelagh having a thin aluminum skin or the Trident having a thick Kevlar covering. Other types of munitions include the Sidewinder, HARM, Harpoon, Tomahawk, and other like munitions.

The indicator 70 may comprise an alann that visually 72 and/or audibly 74 provides a warning signal or alarm. The alarm preferably comprises both visual 72 and audio 74 warning. The alarm may be designed to notify personnel of the degree of likelihood of cook-off, being capable of distinguishing various types of visual and audible warning signals. When an audio warning is used, the signal should be of sufficient volume as to permit warning to individuals within an operational area of the signal. Preferably, the signal is audible within an area of from about one hundred feet or less, more preferably within an area of from about five hundred feet or less, and most preferably within an area of from about one thousand feet or less.

The visual or audible warning also preferably has differing indications that vary in relationship to the degree of likelihood of cook-off. These indicators 70 non-exclusively include flashing lights, red or other colored lights, message boards 70, or other such lighting mechanisms, whistles, horns 74 or other such audible devices, mechanical indicators such as arrow or pointing devices, and other such devices that are capable of alerting a person, system or response mechanism to the possibility of cook-off. Preferably the indicator 70 comprises at least two types of responses, with different responses initiated for various degrees of the likelihood of cook-off. The indicator 70 preferably is an alarm, either configured as a remote or local alarm, for warning of an eminent explosion. In a preferred embodiment, the indicator 70 comprises a warning system having at least a combination of safe, caution and warning responses. In another preferred embodiment, the indicator 70 provides a readout of an actual percentage for the likelihood of cook-off, such as a gauge and/or printout.

In addition to, or in place of, initiating the indicator 70, the present invention may initiate preventive measures 80 comprising at least one means for a corrective response effective to mitigate the likelihood of cook-off. The initiation of the indicator should be in a manner and of sufficient advanced timing for corrective actions to be performed so as to effectively allow reaction of personnel or response mechanism to take preventive steps in countering an explosive threat. These actions may include evacuation of an area, initiation of cooling systems, removal and/or disposal of energetic materials from an area, and other such actions that minimize the destructive consequences of cook-off. This may comprise the arrival of a firefighting unit or the automatic activation of a sprinkler system 82. Alarms would also, when desired, include sufficiently noticeable indicators for such personnel as firefighters combating a fire within a magazine area, or aircrew personnel engaged in combat operations, having alarms sufficiently "loud", "bright", or distinguishable enough to be effective in noisy, obscured and/or confused environments.

Cook-off of an energetic material 10, and the damage occasioned by the cook-off may be mitigated by several factors or devices such as internal cook-off hindrance devices. These devices may be used in conjunction with the process of the present invention. Such devices include thermally activated safety systems for protecting against slow or fast cook-off environments as describe in U.S. Pat. No. 4,961,313 (Dolan), the disclosure of which is herein incorporated by reference. Other systems may include externally activated systems for protecting against slow or fast cook-off. The selection of the type of internal and external systems that may incorporate the present invention to measure the likelihood of cook-off are determinable by those skilled in the art.

EXAMPLE

At least about 50 munitions are selected for comprehensive cook-off data. The acquired data are stored and integrated into the programmable memory of individual munitions of the same type for comparison with heat histories of the munition to determine cook-off.

The stored and integrated data remain with the munition after the munition is placed into service. The munition also has a heat flux sensor and a chemical sensor tied to an electronics processor that can access the data for the munition. As information is provided to the electronics processor, the electronics processor compares the current incoming information with the data. The electronics processor determines the likelihood of cook-off from this comparison. Additional information is provided to the electronic processor from the chemical sensor. The additional chemical sensor information is compared to the likelihood of cook-off determination for confirmation of the cook-off determination. Depending on the likelihood of cook-off determination and/or confirmation of the cook-off, one or more indications may be relayed to a person or a response mechanism for action. The information from the heat flux sensor and chemical sensor are cumulatively stored in the electronics processor, as a factor of time. As more heat flux sensor and chemical sensor information is received by the electronic processor, the cook-off determination is adjusted by the cumulative information, yielding an improved prediction for cook-off.

It should be understood that the foregoing summary, detailed description, example, and drawings of the invention are not intended to be limiting, but are only exemplary of the inventive features which are defined in the claims.

What is claimed is:

1. A process for determining energetic material cook-off comprising the steps of:

continuously measuring an instantaneous heat flux to a munition and monitoring chemical composition of gases released by an energetic material within the munition;

continuously calculating a heat exposure rate and integrated heat flux to an energetic material;

calculating a decomposition chemical formation rate of the energetic material independently of calculating the heat exposure rate;

mathematically factoring the calculated heat exposure rate and integrated heat flux with the calculated decomposition chemical formation rate; and, comparing the factored calculated heat exposure rate and integrated heat flux, and the calculated decomposition chemical formation rate to a predetermined cook-off measurement, wherein the likelihood of cook-off is determined.

2. The process of claim 1, further comprising the step of initiating at least one indicator at a given likelihood of cook-off.

3. The process of claim 2, wherein the indicator comprises a visual warning.

4. The process of claim 3, wherein the visual warning varies in relationship to the likelihood of cook-off.

5. The process of claim 2, wherein the indicator comprises an audible warning.

6. The process of claim 5, wherein the audible warning varies in relationship to the likelihood of cook-off.

7. The process of claim 2, wherein the indicator comprises at least two types of responses.

8. The process of claim 7, wherein different responses are initiated variable for a given likelihood of cook-off.

9. The process of claim 2, wherein the indicator comprises a warning system having at least a combination of safe, caution and warning responses.

10. The process of claim 1, wherein at least one heat flux sensor performs the step of continuously calculating the heat exposure rate and integrated heat flux.

11. The process of claim 10, wherein from about two or more heat flux sensors perform the step of continuously calculating the heat exposure rate and integrated heat flux.

12. The process of claim 11, wherein from about two to about 100 heat flux sensors perform the step of continuously calculating the heat exposure rate and integrated heat flux.

13. The process of claim 11, wherein the heat flux sensors are dispersed throughout the energetic material.

14. The process of claim 1, wherein at least one chemical sensor performs the step of calculating the decomposition chemical formation rate.

15. The process of claim 14, wherein a single chemical sensor performs the step of calculating the decomposition chemical formation rate.

16. The process of claim 1, wherein the predetermined cook-off measurement comprises a mathematically derived value corresponding to a given likelihood of cook-off.

17. The process of claim 1, wherein the energetic material comprises a propellent.

18. The process of claim 1, wherein the energetic material comprises an explosive.

19. The process of claim 1, wherein the energetic material comprises a fuse material.

20. The process of claim 1, further comprising the step of initiating at least one means for a corrective response effective to mitigate the likelihood of cook-off.

* * * * *